US009450347B2

(12) United States Patent
Kondou et al.

(10) Patent No.: US 9,450,347 B2
(45) Date of Patent: Sep. 20, 2016

(54) POWER CORD

(71) Applicant: PANASONIC CORPORATION, Osaka (JP)

(72) Inventors: Maki Kondou, Mie (JP); Takashi Kawamoto, Mie (JP); Ryota Tomiyama, Mie (JP); Tatsuya Takagi, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 401 days.

(21) Appl. No.: 13/972,334

(22) Filed: Aug. 21, 2013

(65) Prior Publication Data

US 2014/0073189 A1 Mar. 13, 2014

(30) Foreign Application Priority Data

Sep. 11, 2012 (JP) ..... 2012-199898
Jun. 5, 2013 (JP) ..... 2013-118947

(51) Int. Cl.

| | |
|---|---|
| ***H01R 13/66*** | (2006.01) |
| ***H01R 13/713*** | (2006.01) |
| ***H01R 24/30*** | (2011.01) |
| *H01R 103/00* | (2006.01) |

(52) U.S. Cl.

CPC ..... *H01R 13/6683* (2013.01); *H01R 13/7137* (2013.01); *H01R 24/30* (2013.01); *H01R 2103/00* (2013.01)

(58) Field of Classification Search

CPC ..... H01R 13/6683; H01R 13/7137; H01R 24/30; H01R 2103/00; H02H 5/04

USPC ..... 361/103

See application file for complete search history.

(56) References Cited

U.S. PATENT DOCUMENTS

| | | | | |
|---|---|---|---|---|
| 4,470,711 | A * | 9/1984 | Brzozowski | 374/179 |
| 5,995,350 | A | 11/1999 | Kopelman | |
| 2009/0251832 | A1* | 10/2009 | Brugner et al. | 361/42 |

FOREIGN PATENT DOCUMENTS

| | | | |
|---|---|---|---|
| JP | 7-67245 | | 3/1995 |
| JP | 8-37060 | | 2/1996 |
| JP | 11-144813 | | 5/1999 |
| JP | 2000-348825 | | 12/2000 |
| JP | 2009043509 | A * | 2/2009 |
| WO | 2009/019801 | | 2/2009 |

OTHER PUBLICATIONS

Machine Translation of Japanese Patent Document JP 2009043509 A, Inagaki et al., Feb. 12, 2009.*
Search report from E.P.O., mail date is Jan. 27, 2014.
U.S. Appl. No. 13/957,742 to Maki Kondou et al., which was filed on Aug. 2, 2013.

* cited by examiner

*Primary Examiner* — Thienvu Tran
*Assistant Examiner* — Kevin J Comber
(74) *Attorney, Agent, or Firm* — Greenblum & Bernstein, P.L.C.

(57) ABSTRACT

A power cord includes a plug having blades configured to be inserted into blade insertion holes of an electrical outlet, respectively. The power cord further includes thermal sensors provided for the blades one each. When a temperature detected with any of the thermal sensors is higher than a prescribed temperature, electric power is stopped from being supplied to a load from the blades.

8 Claims, 10 Drawing Sheets

POWER CORD

TECHNICAL FIELD

The invention relates to a power cord.

BACKGROUND ART

Conventionally, there is provided a power cord having a plug, a thermal sensor, and a cut-off means (for example, Japanese Patent Application Publication No. 7-67245 A). The plug is configured to be connected to an electrical outlet (or socket). The thermal sensor is configured to detect (measure) a temperature of the plug. The cut-off means is configured to stop electric power from being supplied from the plug side to a load when an abnormal rise in temperature is detected with the thermal sensor. The plug has blades configured to be inserted into the electrical outlet to come into contact with receptacle contacts in the electrical outlet, respectively.

In this sort of power cord, even in the case of abnormal heat generation due to contact failure between the electrical outlet and the blades of the plug, it is possible to protect the plug from the abnormal heat by stopping electricity feeding.

In the power cord including only one thermal sensor, there is a concern that safety is impaired by a delay in response to a temperature rise of a blade caused by a comparatively low correlation between the blade, furthest from the thermal sensor, of the blades of the plug and an output of the thermal sensor.

SUMMARY OF INVENTION

The present invention has been achieved in view of the above circumstances, and an object thereof is to provide a power cord capable of improving safety.

A power cord (100) of the present invention comprises a plug (1), a load connection portion (2) and a cut-off means (3). The plug (1) comprises blades (11) configured to be inserted into blade insertion holes (201) of an electrical outlet (200), respectively, and thermal sensors (5) provided for the blades (11) at least one each. Each of the thermal sensors (5) is configured to detect (measure) a temperature of a corresponding blade (11). The load connection portion (2) is configured to be connected to a load (300). The cut-off means (3) is configured to stop electric power from being supplied to a side of the load connection portion (2) from a side of the blades (11) when a temperature detected with any of the thermal sensors (5) is higher than a prescribed temperature.

In an embodiment, the thermal sensors (5) are in contact with the blades (11) one each.

In an embodiment, each distance between each of the thermal sensors (5) and a blade (11) corresponding thereto (5) is smaller than a distance between the blades (11).

In an embodiment, any one of the thermal sensors (5) is not arranged between the blades (11).

In an embodiment, the plug (1) comprises a sensor holder (9). The sensor holder (9) is made from insulating material and retains the thermal sensors (5) such that the sensor holder (9) intervenes between each of the thermal sensors (5) and a blade (11) corresponding thereto (5).

In the invention, it is possible to improve safety in comparison with the case where only one thermal sensor is provided.

BRIEF DESCRIPTION OF DRAWINGS

Preferred embodiments of the invention will now be described in further details. Other features and advantages of the present invention will become better understood with regard to the following detailed description and accompanying drawings where.

DESCRIPTION OF EMBODIMENTS

First Embodiment

Figure 1:
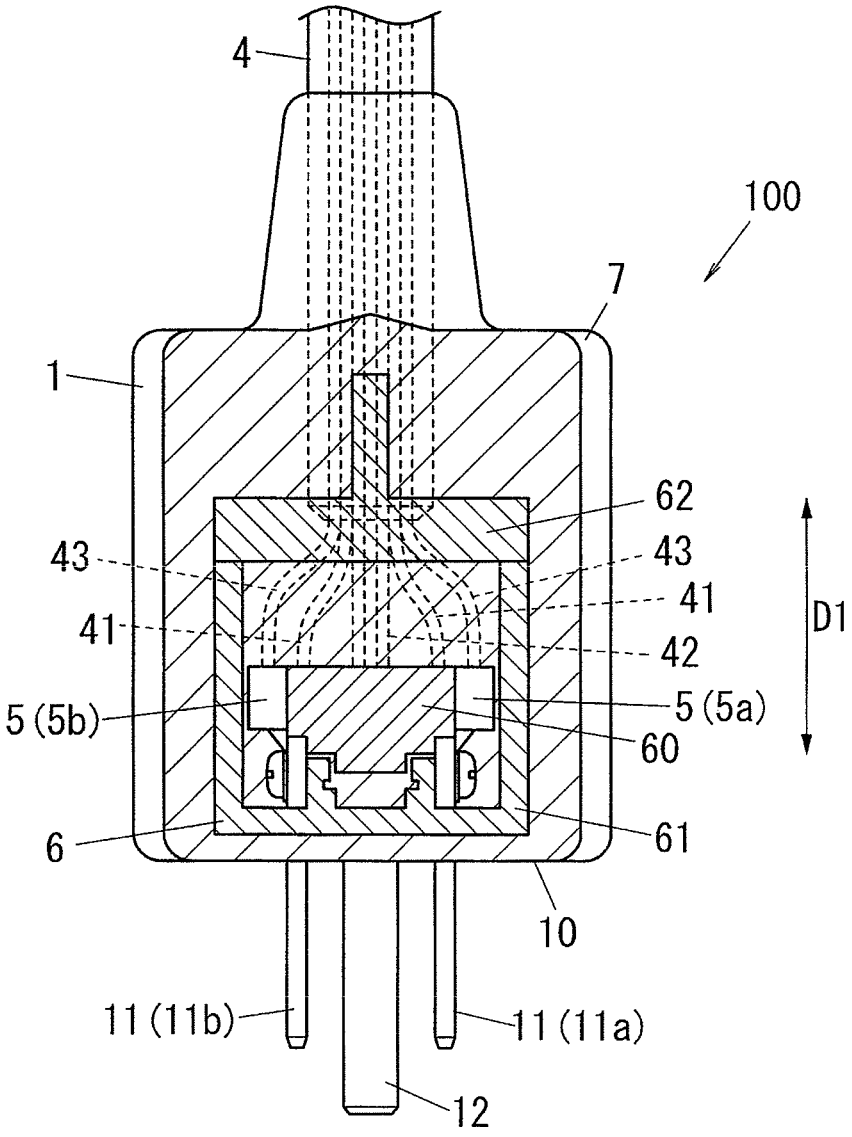
FIG. 1 is a sectional view of a plug in accordance with a first embodiment of the present invention, taken along line B-B of FIG. 3.

A power cord (100) of the present embodiment includes a plug (a male plug) (1), a load connection portion (2) and a cut-off means (3). The plug (1) includes male connectors (11) and thermal sensors (5). The male connectors (11) are configured to be inserted into apertures (201) of an electrical outlet (200), respectively. The thermal sensors (5) are provided for the male connectors (11) at least one each. Each of the thermal sensors (5) is configured to detect (measure) a temperature of a corresponding male connector (11). The load connection portion (2) is configured to be connected to a load (300). The cut-off means (3) is configured to stop electric power from being supplied to a side of the load connection portion (2) from a side of the male connectors (11) when a temperature detected with any of the thermal sensors (5) is higher than a prescribed temperature.

In an example, the male connectors (11) are first and second male connectors (11*a* and 11*b*), and the apertures (201) are first and second apertures (201*a* and 201*b*). That is, the first and second male connectors (11*a* and 11*b*) are configured to be inserted into the first and second apertures (201*a* and 201*b*), respectively. In another example, the electrical outlet (200) further includes a ground (earth) aperture (202), while the plug (1) further includes a ground male connecter (12) configured to be inserted into the ground aperture (202).

Figure 2:
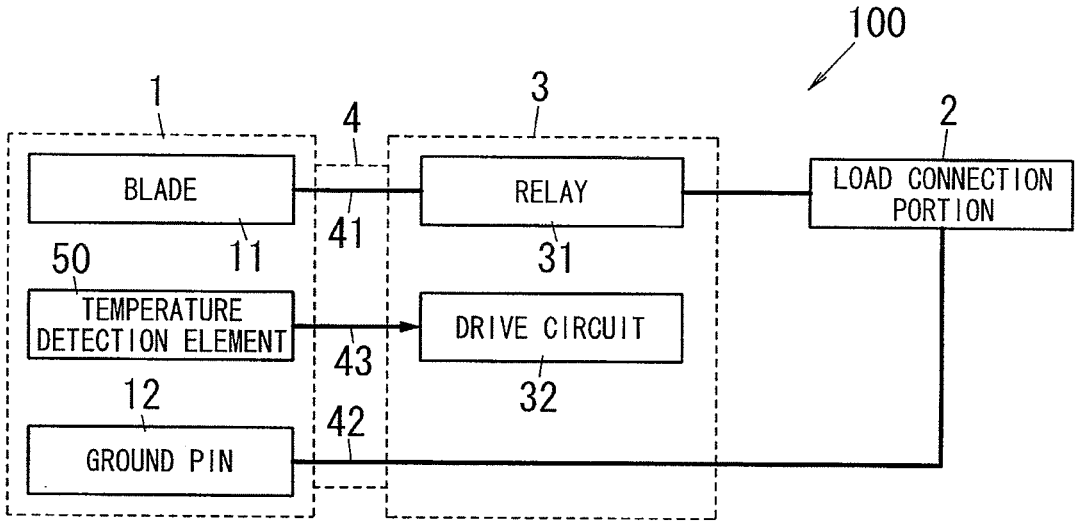
FIG. 2 is a block diagram of the plug.
Figure 4:
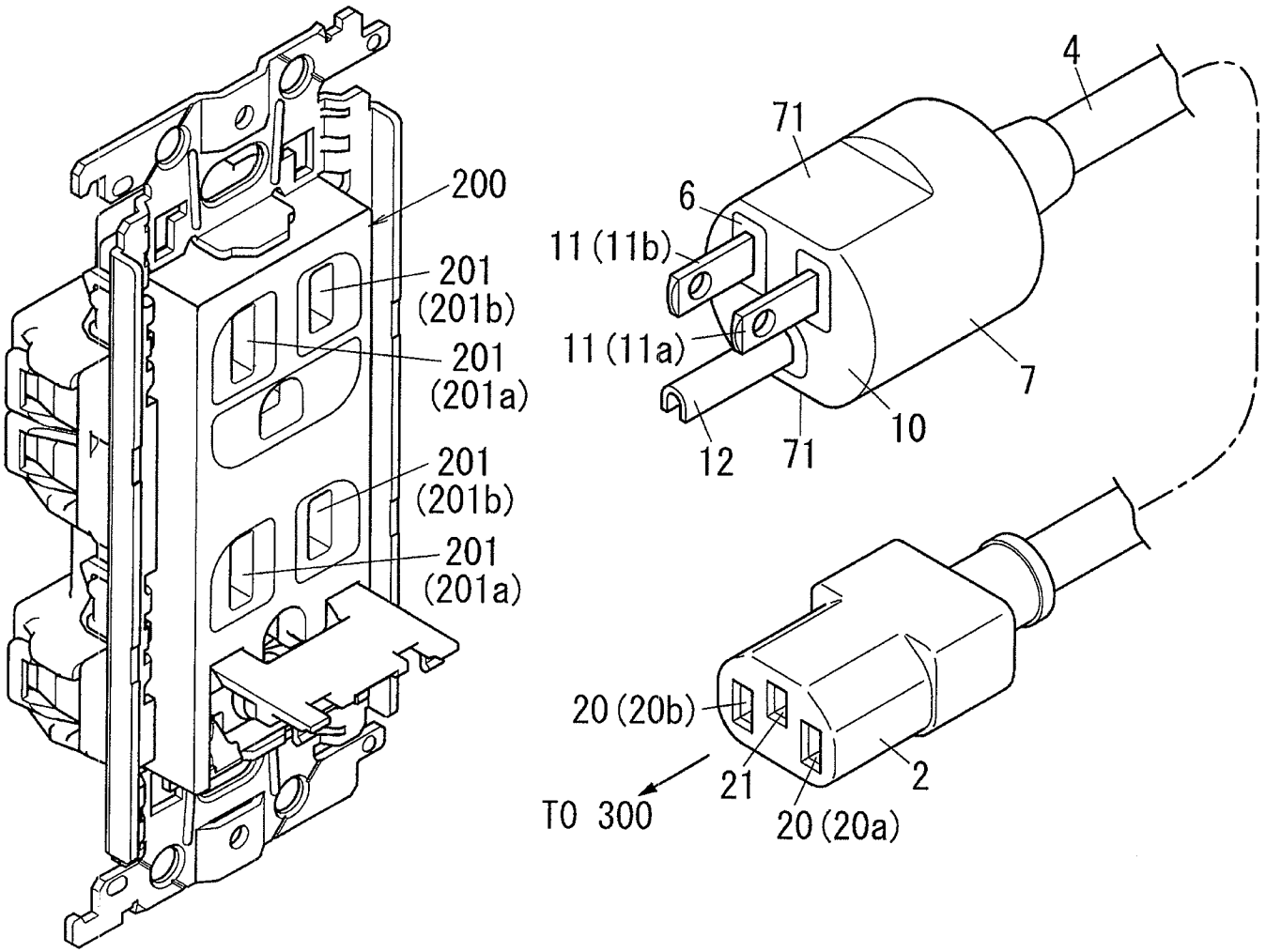
FIG. 4 is a perspective view of a power cord in the first embodiment and an electrical outlet.

A concrete example of the power cord (100) is explained. As shown in FIGS. 2 and 4, a power cord 100 includes a plug 1, a load connection portion 2, and a cut-off device 3 as the cut-off means. The plug 1 is configured to be connected to an electrical outlet 200. The load connection portion 2 is configured to be connected to a load 300. The cut-off device 3 is configured to allow and stop electric power from being and to be supplied to the load connection portion 2 from the plug 1.

In the embodiment, the load connection portion 2 is, for example, a connector assembly in which the cut-off device 3 is put. The connector assembly is a female plug that conforms to, but not limited to, JIS C 8303 or IEC 60320-C13 in shape, and includes first and second receptacle contacts (not shown) in the back of first and second aperture 20(20*a*) and 20(20*b*) and, as an option, a ground receptacle contact (not shown) in the back of a ground aperture 21. The first and second receptacle contacts are electrically connected to the first and second male connectors (11*a* and 11*b*), respectively, and the ground receptacle contact is electrically connected to the ground male connecter (12). In an example, the load connection portion 2 is electric wires connected to terminals (for example, screw terminal blocks) of the load 300.

In this example, the cut-off device 3 is placed in the plug 1 or intervenes between both ends of a cable 4 to be described. Thus, the position of the cut-off device 3 is optional, and accordingly in the example of FIG. 2, the cut-off device 3 is shown separately from the load connection portion 2.

Figure 3:
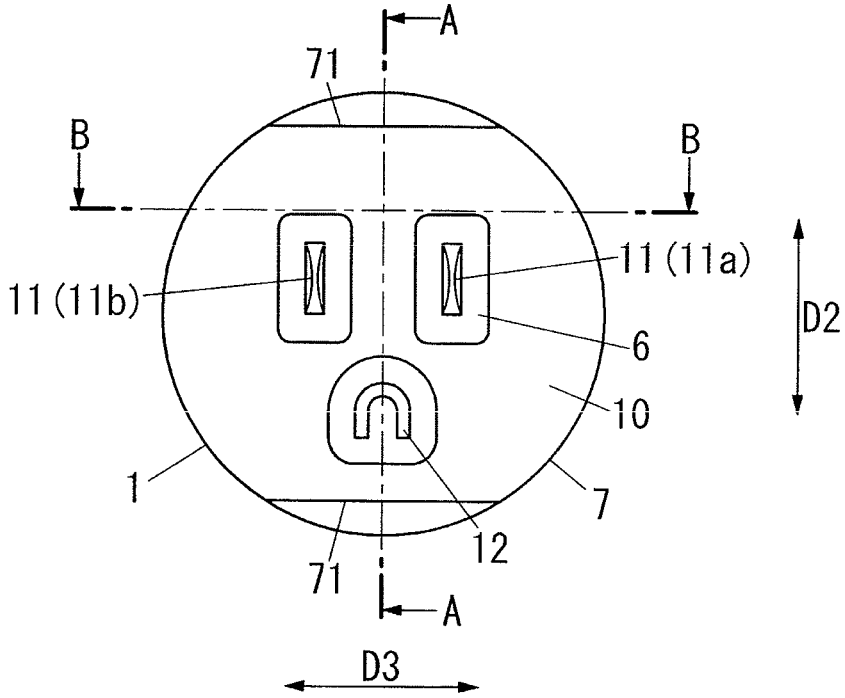
FIG. 3 is a front view of the plug.

The plug 1 is, for example, a plug having two electrodes and a ground electrode, specified in JIS C 8303. As shown in FIGS. 3 and 4, the plug 1 includes two blades 11 (11*a* and 11*b*) for power supply corresponding to line (hot) and neutral, respectively, and a ground pin 12 corresponding to ground. Each of the blades 11 and the ground pin 12 is made of, for example, electrically conductive material such as metal.

The blades 11 are connected to the cut-off device 3 through power wires 41 included in the cable 4 connecting the plug 1 and the cut-off device 3. The cut-off device 3 includes a relay 31 such as, e.g., an electromagnetic relay, configured to make or break an electrical connection between one or two of the blades 11 and the load connection portion 2, and a drive circuit 32 configured to drive the relay 31.

The ground pin 12 is connected to the load connection portion 2 through a ground wire 42 included in the cable 4.

As shown in FIGS. 1, 3 and 4, the blades 11 and the ground pin 12 protrude from an end face 10 of the plug 1, toward a first side of a first direction D1 perpendicular to the end face 10 (for the purpose of simplicity, also referred to as "forward"). In addition, for the purpose of simplicity, the first side and the second side of the first direction D1 are also referred to as a "front side" and a "back side", respectively. The blades 11 are placed at a first side of the end face 10 on a first side of a second direction D2 perpendicular to the first direction D1, while the ground pin 12 is placed at a second side of the end face 10 on a second side of the second direction D2. For the purpose of simplicity, the first side and the second side of the second direction D2 are also referred to as an "upside" and a "downside", respectively. In addition, first and second blades 11*a* and 11*b* as the blades 11 are arranged on first and second sides of a third direction D3 perpendicular to the second direction D2 (and the first direction D1), respectively. For the purpose of simplicity, the first side and second side of the third direction D3 are also referred to as a "right side" and a "left side", respectively.

Figure 5:
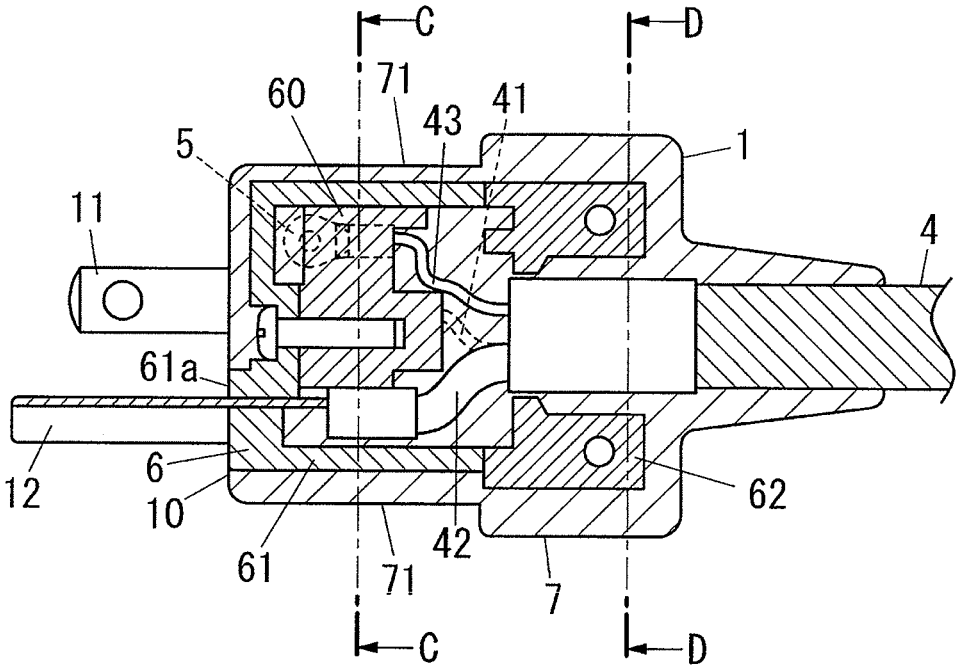
FIG. 5 is a sectional view of the plug taken along line A-A of FIG. 3.
Figure 6:
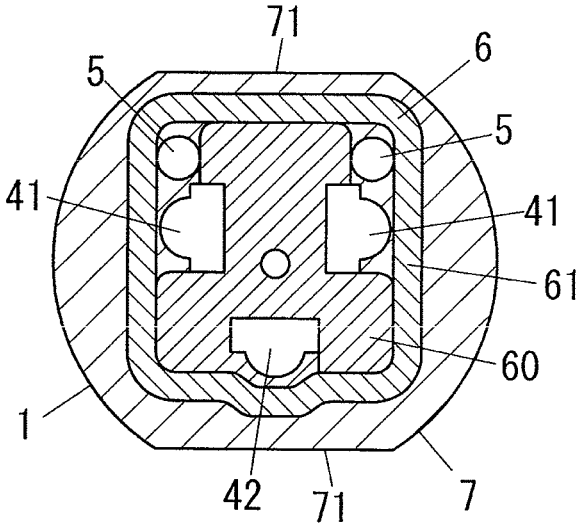
FIG. 6 is a sectional view of the plug taken along line C-C of FIG. 5.
Figure 7:
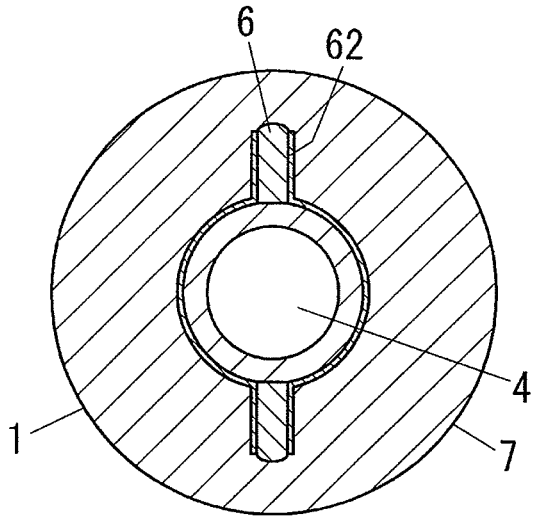
FIG. 7 is a sectional view of the plug taken along line D-D of FIG. 5.

As shown in FIGS. 5 to 7, the plug 1 includes a core 6 and an enclosure 7. The core 6 is made from, e.g., an insulating material such as synthetic resin and retains the blades 11 and the ground pin 12. The enclosure 7 is a synthetic resin molding in which the core 6 is sealed. The core 6 includes an inner frame 60, a cover (a front cover) 61 and a cover (a back cover) 62. The inner frame 60 retains the blades 11 and the ground pin 12 by engaging therewith for example. The cover 61 is shaped like a cylinder having a base (a front base) 61*a* on the front side and an opening (a back opening) on the back side, and the blades 11 and the ground pin 12 are inserted into the base 61*a*. The cover 62 is joined to an end (a back end) of the cover 61 on the back side. The enclosure 7 is shaped like a cylinder with an axis parallel in the first direction D1 (a front-back direction) as a whole. The enclosure 7 is provided, on the front side, with recesses 71 on the upside and downside.

Figure 8:
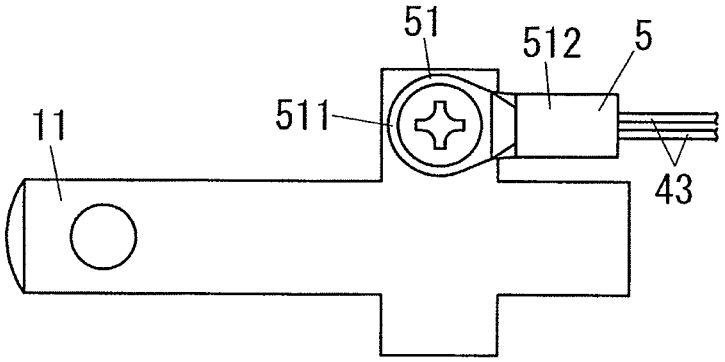
FIG. 8 is a side view of a blade with a thermal sensor fixed thereto, in the plug.
Figure 9:
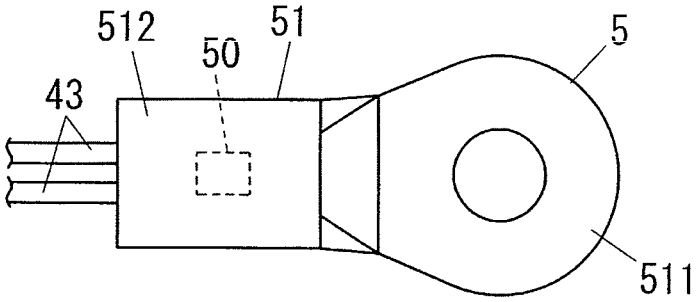
FIG. 9 is a side view of the thermal sensor.
Figure 10:
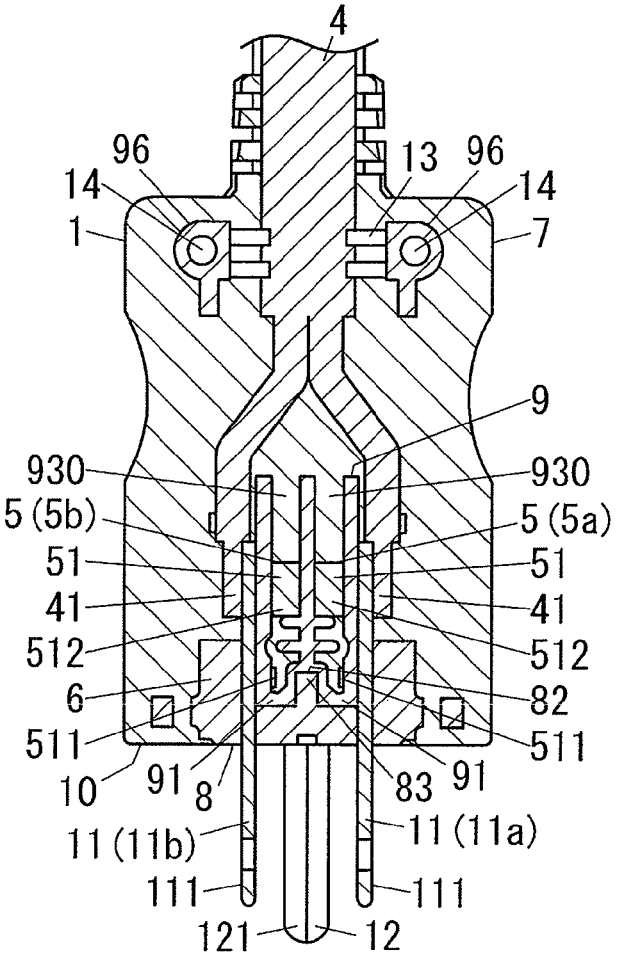
FIG. 10 is a sectional view of a plug in accordance with a second embodiment of the present invention, taken along line E-E of FIG. 11.
Figure 11:
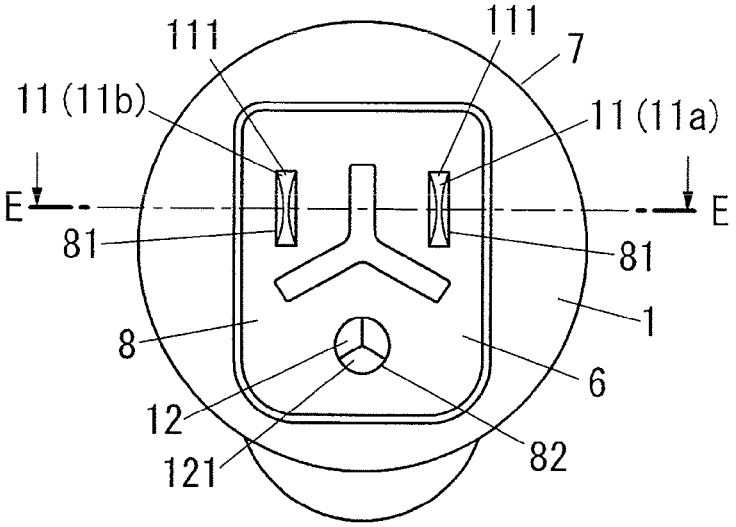
FIG. 11 is a front view of the plug in the second embodiment.

FIG. 1 is a sectional view of the plug taken along line B-B of FIG. 3. As shown in FIGS. 1 and 8, two thermal sensors 5 are fixed to the blades 11 one each. That is, first and second thermal sensors 5*a* and 5*b* are fixed to the first and second blades 11*a* and 11*b*, respectively. As shown in FIG. 9, each thermal sensor 5 is formed of a temperature detection element 50, and a holder 51 which is made of metal and retains the temperature detection element 50. An example of the temperature detection element 50 is a temperature-sensitive resistor (so called a thermistor) having a comparatively large change in resistance value in response to a temperature change. The holder 51 has a fixed part 511 and a body part 512. The fixed part 511 is shaped like a ring as a whole in the same way as a known lug terminal and configured to be fixed to a corresponding blade 11 with a screw. The body part 512 houses therein the thermistor. In the thermal sensors 5*a* and 5*b* having axes parallel with the first direction D1, the fixed part 511 of the thermal sensor 5*a* is fixed to an outer face (a right face) of the corresponding blade 11*a*, and the body part 512 thereof (5*a*) is placed on the back side of the fixed part 511, while the fixed part 511 of the thermal sensor 5*b* is fixed to an outer face (a left face) of the corresponding blade 11*b*, and the body part 512 thereof (5*b*) is placed on the back side of the fixed part 511 thereof (5*b*). Each temperature detection element 50 of the thermal sensors 5 is connected to the drive circuit 32 of the cut-off device 3 through signal wires 43 drawn out from an end face (a back end face) of a body part 512 of its own holder 51. Electric insulation between a holder 51 and a set of a temperature detection element 50 and signal wires 43 in each thermal sensor 5 is secured by epoxy resin (not shown) filled in the body part 512 of the holder 51. The signal wires 43 are banded together along with the power wires 41 and the ground wire(s) 42, which constitute the cable 4.

The drive circuit 32 is configured to turn the relay 31 off when a temperature detected with any temperature detection element 50 of the thermal sensors 5 is higher than a prescribed temperature. The drive circuit 32 is also configured to keep the relay 31 turned on, namely to allow electric power to be supplied from the plug 1 side to the load connection portion 2 side when a temperature detected with any thermal sensor 5 is equal to or lower than the prescribed temperature. The aforementioned drive circuit 32 can be realized by known electronic circuits, and accordingly are not described in detail herein. For the purpose of simplicity, FIG. 2 shows one set of a blade 11 and a temperature detection element 50. The relay 31 may be a single pole relay that has only one set of movable and fixed contacts intervening between one blade 11 (one power wire 41) and a corresponding one of the apertures 20 in the load connection portion 2, and is configured to turn on and off power to the load connection portion 2 (namely the load 300). Alternately, the relay 31 may be a dual pole relay that has a first set of movable and fixed contacts intervening between one blade 11 and a corresponding one of the apertures 20 in the load connection portion 2 and a second set of movable and fixed contacts intervening between another blade 11 and corresponding another aperture 20, and is configured to turn on and off power to the load connection portion 2. In addition, the relay 31 may further include a function like known circuit breakers, configured to interrupt (open) an electrical circuit also in the case where a fault such as electric leakage or overcurrent is detected.

In the configuration of the embodiment, it is possible to improve safety in comparison with a power cord with only one thermal sensor.

Each thermal sensor 5 has a holder 51 of which fixed part 511 is in contact with one blade 11. Any distance between each thermal sensor 5 and a blade 11 in contact therewith (5) is smaller than a distance between the blades 11. Specifically, a first distance between the first thermal sensor 5*a* and the first blade 11*a* is smaller than the distance between the blades 11, and a second distance between the second thermal sensor 5*b* and the second blade 11*b* is smaller than the distance between the blades 11 as well. It is therefore possible to enhance correlation between each output of the thermal sensors 5 and a temperature of a corresponding blade 11 in comparison with the case where each thermal sensor 5 and a corresponding blade 11 is spaced, or the case where a distance between a thermal sensor 5 and a corresponding blade 11 is larger than a distance between the blades 11.

Each thermal sensor 5 is fixed on an opposite face of a corresponding blade 11 from another blade 11, and no thermal sensor 5 is present between the blades 11. Accordingly, each output of the thermal sensors 5 has a less influence on a temperature of a blade 11 separate from a corresponding blade 11 in comparison with the case where a thermal sensor 5 is arranged between the blades 11. As a result, each output of the thermal sensors 5 has a stronger influence on a temperature of a corresponding blade 11. It is also possible to preferably prevent the blades 11 from short-circuiting through the thermal sensors 5 in comparison with the case where a(the) thermal sensor(s) 5 is(are) arranged between the blades 11.

Second Embodiment

Like elements are assigned the same reference numerals as depicted in the first embodiment, and not described in detail herein.

As shown in FIGS. 10 to 13, a core 6 in the present embodiment includes: a body 8 into which blades 11 and a ground pin 12 are inserted; and a sensor holder 9 which is joined to the body 8 and retains two thermal sensors 5. Each of the body 8 and the sensor holder 9 is made from, for example, synthetic resin. The body 8 is covered with an enclosure 7 so that a face (a front face) of the body 8 on a front side (a first side of a first direction D1) is exposed and flush with an end face 10 of a plug 1.

Figure 12A:
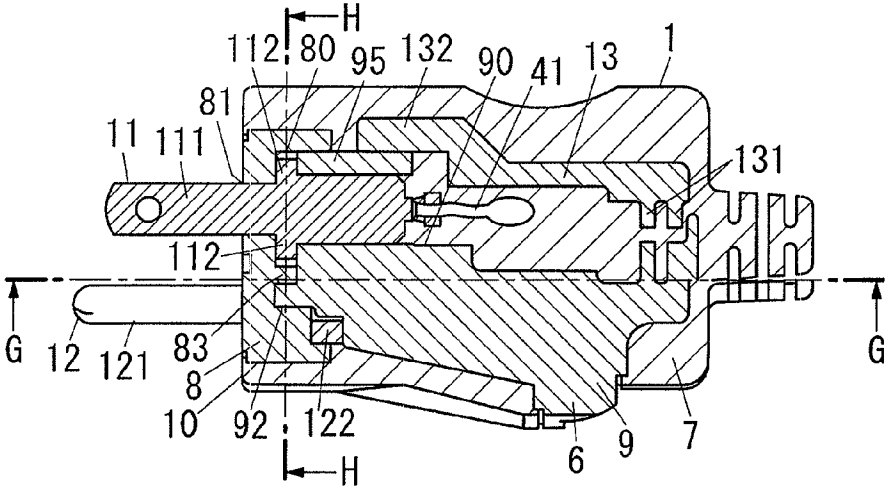
FIGS. 12A to 12C are sectional views of: the plug taken along line F-F of FIG. 12C; the plug taken along line G-G of FIG. 12A; and the plug taken along line H-H of FIG. 12A, respectively.
Figure 12B:
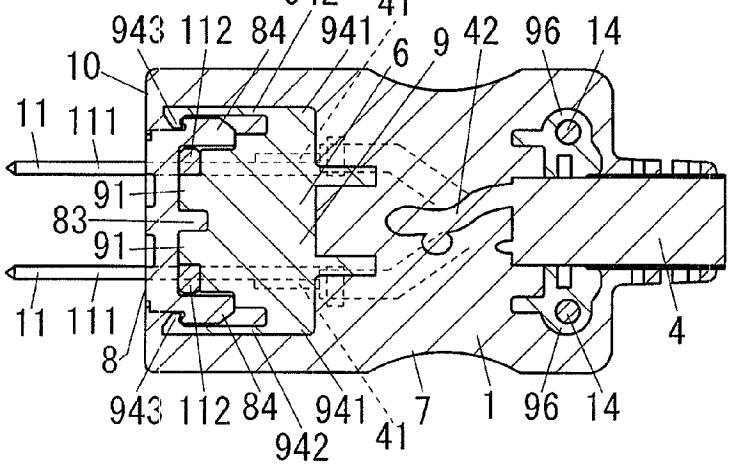
Figure 12C:
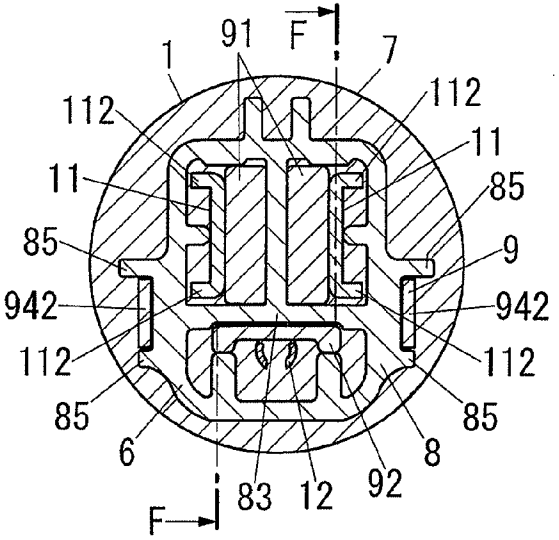
Figure 13:
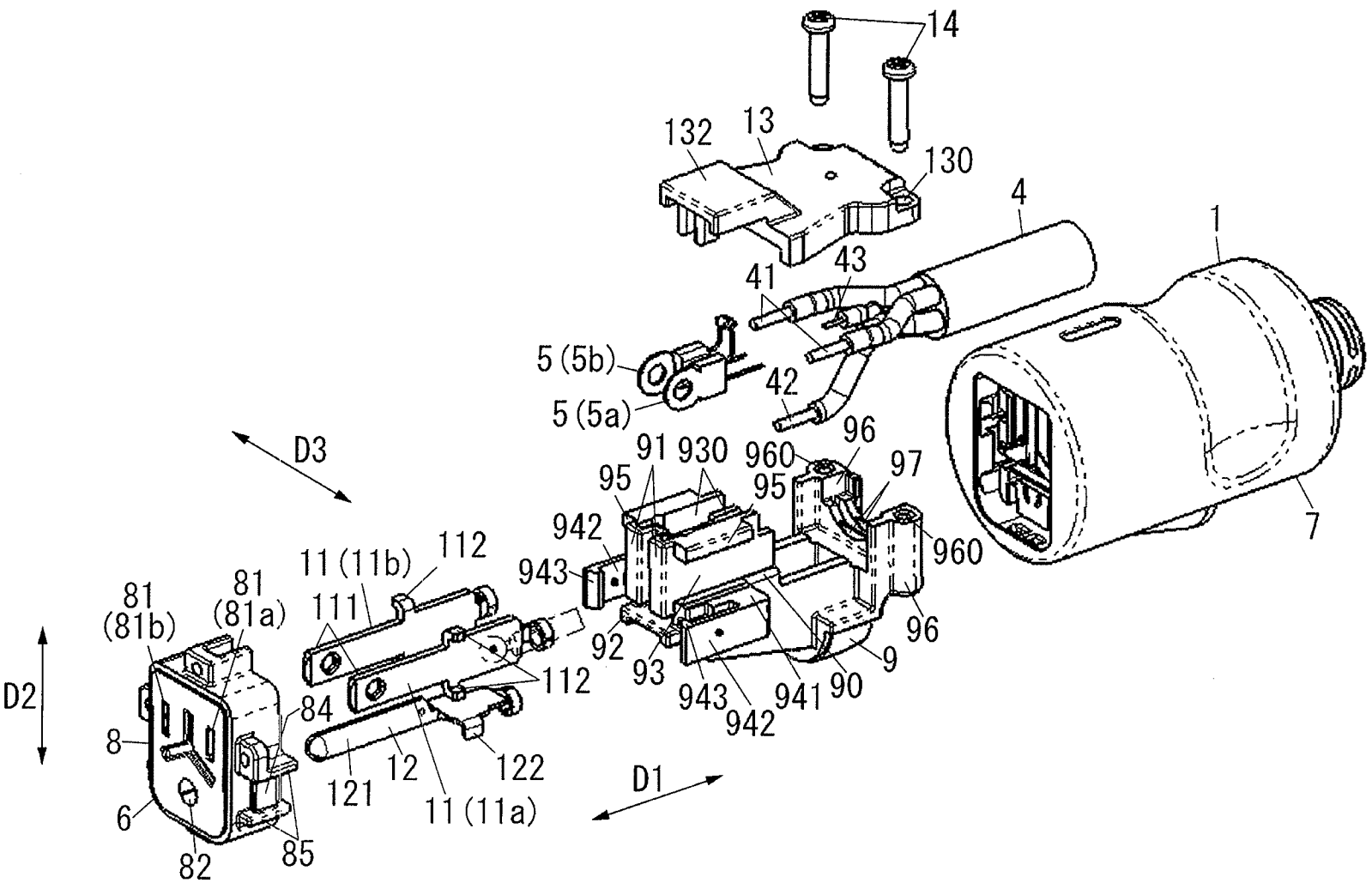
FIG. 13 is an exploded perspective view of the plug.
Figure 14B:
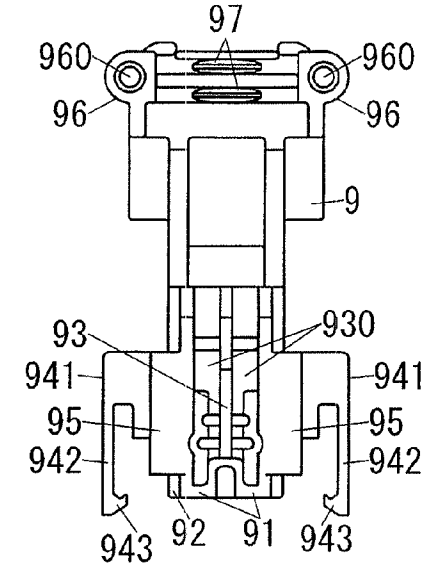
FIGS. 14A to 14D are a front view of a sensor holder in the plug, a plan view of the sensor holder, a right side view of the sensor holder and a back view of the sensor holder, respectively.
Figure 14C:
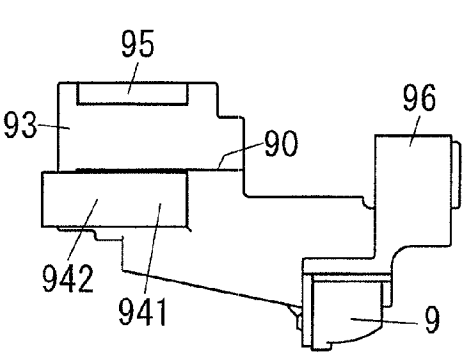
Figure 14D:
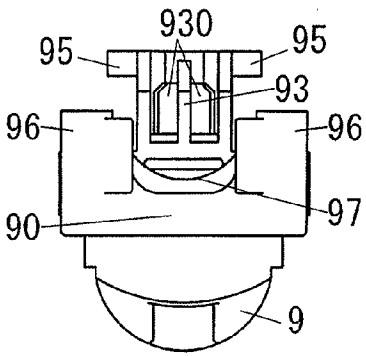
Figure 14A:
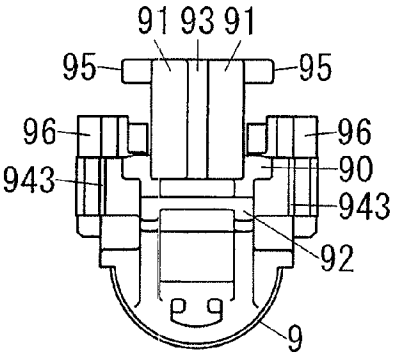

The blades 11 are arranged so that each thickness direction thereof (11) is parallel with a third direction (a crosswise direction) D3. Each of the blades 11 has a flat protrusion 111 which protrudes from the end face 10 of the core 6 (the body 8) forward (toward the first side of the first direction D1), and is configured to come into contact with a receptacle contact, corresponding line (hot) or neutral, in an electrical outlet (see 200 in FIG. 4) as a connection target. As shown in FIGS. 12A and 13, each blade 11 has two retainers 112 which protrude therefrom (11) further than the protrusion 111 in a second direction D2 (a vertical direction).

The ground pin 12 has a protrusion 121 which is shaped like a cylinder having an axis parallel with the first direction D1 and protrudes forward from the end face 10 of the plug 1. The ground pin 12 is configured so that the protrusion 121 comes into contact with a receptacle contact (not shown), corresponding to ground (earth), in the electrical outlet 200 as a connection target. The ground pin 12 further includes two retainers 122 which protrude therefrom (12) further than the protrusion 121 in the third direction D3 (the crosswise direction).

The body 8 is provided with a depression 80 on a back side (a second side of the first direction D1). Part of each blade 11 and part of the ground pin 12 are put in the depression 80. A bottom of the depression 80 is provided with: first and second through holes 81(81*a*) and 81(81*b*) into which the protrusions 111 of first and second blades 11*a* and 11*b* as the blades 11 are inserted, respectively; and a ground through hole 82 into which the protrusion 121 of the ground pin 12 is inserted. Each through hole 81 is shaped so that a corresponding protrusion 111 can be inserted thereinto (81) but a corresponding retainer 112 cannot be inserted thereinto. The ground through hole 82 is shaped so that a corresponding protrusion 121 can be inserted thereinto (82) but a corresponding retainer 122 cannot be inserted thereinto. The through holes 81 are arranged along the third direction D3 on an upside (a first side of the second direction D2), while the through hole 82 is placed on a downside (a second side of the second direction D2) below an intermediate of the through holes 81.

The body 8 is also provided with a T-shaped partition wall 83 which is protruded from the bottom of the depression 80 backward (toward the second side of the first direction D1), and separates a blade 11 from another while separating the blades 11 from the ground pin 12.

As shown in FIGS. 14A to 14D, the sensor holder 9 includes a main body 90, a wall 93 and two pinching parts 95. The main body 90 is placed on a downside of the blades 11. The wall 93 is protruded from the main body 90 upward (toward the first side of the second direction D2) to intervene between the blades 11. The pinching parts 95 are protruded from an end face (an upper end face) of the wall 93 toward both sides of the third direction D3 to individually pinch the blades 11. Specifically, the wall 93 is shaped to have the end face (the upper end face) shaped like a "W" (see FIG. 14B), and the pinching parts 95 are protruded from outer parts of the wall 93.

The sensor holder 9 is provided with two first projections (first bends) 91 and a second projection (second bend) 92 on an end (a front end) thereof (9) on the front side. Each first projection 91 is inserted into the depression 80 to intervene between a corresponding blade 11 and the partition wall 83. The second projection 92 is inserted into the depression 80 to intervene between the ground pin 12 and the partition wall 83. The partition wall 83 intervenes between each two adjacent projections of the first projections 91 and the second projection 92, thereby positioning the body 8 and the sensor holder 9 with respect to each other.

The sensor holder 9 further includes two spring saddles 941 and two spring pieces 942. The spring saddles 941 are protruded from around a front side of the main body 90 toward both sides of the third direction D3. The spring pieces 942 are each protruded forward from the spring saddles 941. Each spring piece 942 is shaped like a flat rectangle of which thickness direction is parallel with the third direction D3, and each tip end side of the spring pieces 942 is free to bend in the third direction D3. Each spring piece 942 is provided with an engagement nail 943 on its own tip end, which protrudes from its own inner face in the third direction D3. The body 8 is provided with two engagement protrusions 84 protruding from two outer faces thereof (8). The body 8 is pinched between the spring pieces 942 in the third direction D3, and the engagement nails 943 each engage with the engagement protrusions 84. That is, each engagement nail 943 comes into contact with a front side of a corresponding engagement protrusion 84. As a result, the body 8 and the sensor holder 9 are joined together. Each engagement protrusion 84 is provided with an inclined plane on an end (a back end) thereof (84) on the back side, and the inclined plane becomes gradually smaller in protrusion length backward. Each engagement nail 943 is provided with an inclined plane on its own end (front end) on the front side, and the inclined plane thereof (943) becomes gradually smaller in protrusion length forward. In order to join the body 8 and the sensor holder 9 together, the body 8 is first pressed between the spring pieces 942 from positions where the body 8 and the sensor holder 9 are apart from each other in one direction (the first direction D1) with the engagement protrusions 84 aligned with the respective engagement nails 943 in the one direction (D1). The inclined planes of the engagement protrusions 84 and the inclined planes of the engagement nails 943 then slide on each other, while the spring pieces 942 are deformed elastically. When the engagement protrusions 84 reaches the front sides of the engagement protrusions 84, the spring pieces 942 elastically return to the original positions thereof and the engagement nails 943 engage with the engagement protrusions 84. The body 8 is further provided with two pinching parts 85 protruding from the two outer faces thereof in the third direction D3. Two pinching parts 85 on each outer face are formed so that a corresponding spring piece 942 of the sensor holder 9 is pinched therebetween (85) from both sides in the second direction D2.

A cable 4 includes part parallel with the first direction D1 and is drawn out from the core 6 (the sensor holder 9) backward. The sensor holder 9 is provided with two screwed parts 96 which protrudes upward from an end (a back end) of the main body 90 on the back side so that the cable 4 intervenes between the screwed parts 96 arranged at both sides of the third direction D3 (i.e., a diameter direction of the cable 4).

The plug 1 further includes a tension stopper 13 which pinches the cable 4 along with the core 6 (the sensor holder 9). The tension stopper 13 is housed and retained in the enclosure 7 along with the core 6 (the body 8 and the sensor holder 9) and the like by insert molding. The tension stopper 13 is made from synthetic resin for example. Each screwed part 96 of the sensor holder 9 has a tapped hole 960 forming an opening on its own (96) end face (upper end face). The tension stopper 13 is provided with two insertion holes 130 corresponding to the tapped holes 960. The tension stopper 13 is fixed to the sensor holder 9 with two screws 14 inserted into the insertion holes 130 to be screwed into the tapped holes 960.

The sensor holder 9 further includes ribs (linear projections) 97 which protrude upward from between the screwed parts 96. The tension stopper 13 further includes ribs (linear projections) 131 which protrude from a face (a lower face) of thereof (13) on the downside toward the second side of the second direction D2 (downward). A distance between the ribs 97 and the ribs 131 with the tension stopper 13 joined to the sensor holder 9 is smaller than an outer diameter of the cable 14 in undeformed state. That is, the ribs 97 and the ribs 131 bite the cable 4, thereby preventing a positional displacement of the cable 4 with respect to the core 6 (especially, the sensor holder 9).

In a manufacturing process before the enclosure 7 is formed by the insert molding, inner faces of the through holes 81 and 82 prohibit the blades 11 and ground pin 12 from being displaced in the second and third directions D2 and D3 with respect to the core 6. In addition, each through hole 81 of the body 8 is shaped and sized such that retainers 112 of a corresponding blade 11 are prohibited from passing therethrough (81). Similarly, the through hole 82 is shaped and sized such that retainers 122 of the ground pin 12 are prohibited from passing therethrough (82). Therefore, the retainers 112 and 122 come into contact with the bottom of the depression 80 of the body 8, thereby prohibiting the blades 11 and the ground pin 12 from displacing forward (toward their projecting direction) with respect to the core 6. The sensor holder 9 is placed at the back side of (just behind) the retainers 112 and 122 of the blades 11 and the ground pin 12. Therefore, the sensor holder 9 comes into contact with the retainers 112 and 122, thereby prohibiting the blades 11 and the ground pin 12 from being displaced backward with respect to the core 6.

Figure 15:
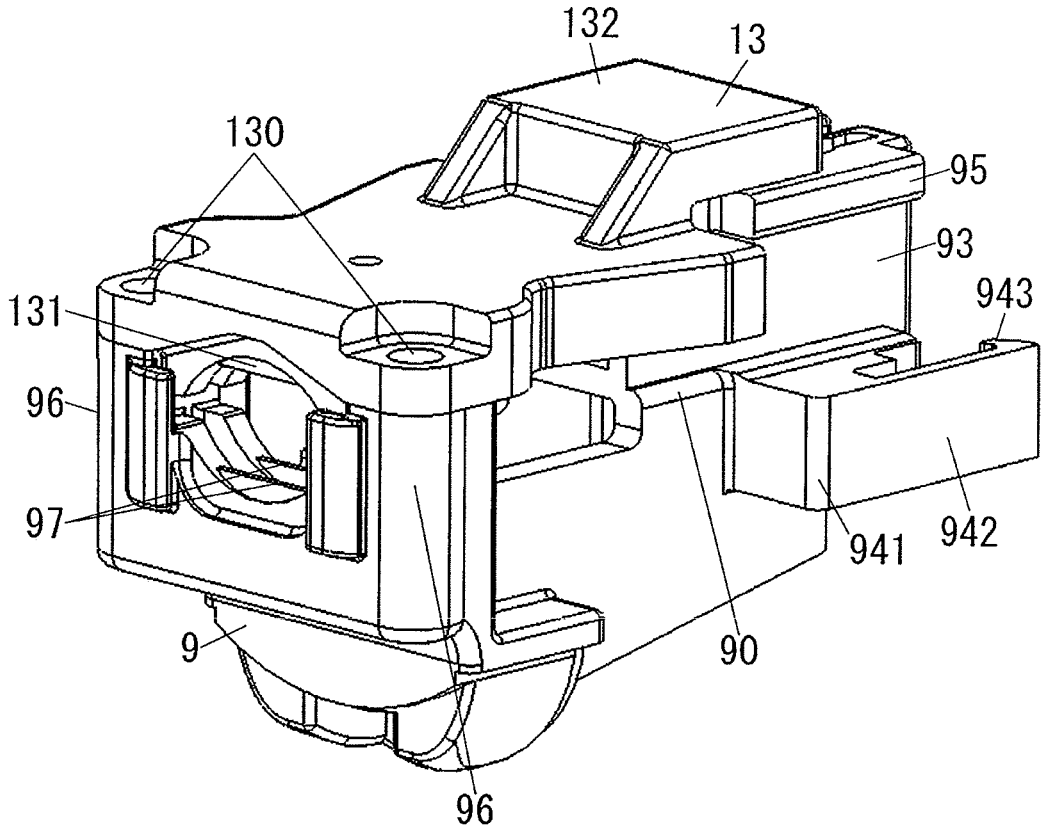
FIG. 15 is a perspective view of the sensor holder coupled with a tension stopper.

The wall 93 of the sensor holder 9 includes two sensor storing recesses 930 each of which opens upward and backward. The two thermal sensors 5 are respectively fit into the two sensor storing recesses 930 to be retained with the sensor holder 9. That is, an outer part of the wall 93 on a right side (a first side of the third direction D3) intervenes between a first thermal sensor 5*a* on the right side and the first blade 11*a*, while another outer part of the wall 93 on a left side (a second side of the third direction D3) intervenes between a second thermal sensor 5*b* on the left side and the second blade 11. As shown in FIG. 15, the tension stopper 13 includes a cover 132 covering the sensor storing recesses 930 when the tension stopper 13 is joined to the sensor holder 9.

Figure 16:
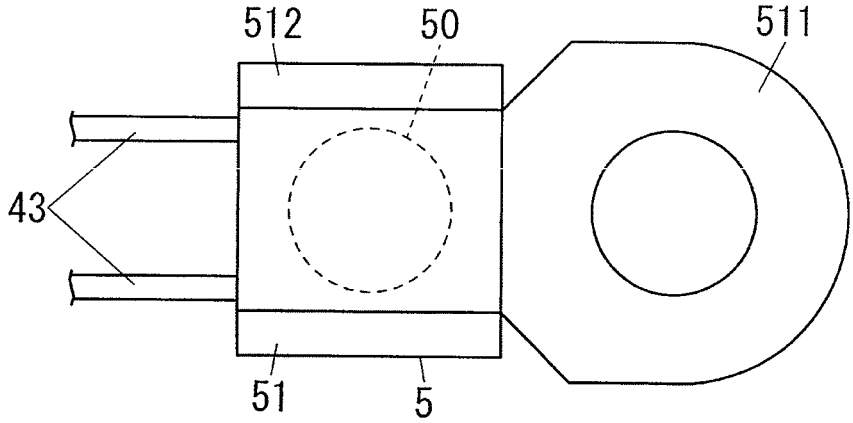
FIG. 16 is a side view of a thermal sensor in the second embodiment.

An external form of the plug 1 differs from that of the plug 1 in the first embodiment and an external form of each thermal sensor 5 shown in FIG. 16 also differs from that of each thermal sensor 5 in the first embodiment, but their external forms are optional, and accordingly not described in detail herein.

In the embodiment, it is possible to improve electric insulation between each set of a thermal sensor 5 (a temperature detection element 50) and a signal wire 43 connected therewith and each set of a blade 11 and a power wire 41 connected therewith, through the sensor holder 9.

In the manufacturing process before the enclosure 7 is formed by the insert molding, the body 8 and the sensor holder 9 are joined together by engagement. However, the present invention is not limited to this. For example, the body 8 and the sensor holder 9 may be joined together with screws in addition to engagement.

Each power wire 41 may be provided with a through hole (not shown) such that a rivet rod provided for a blade 11 or the sensor holder 9 is inserted into the through hole to be upset (deformed), thereby fixing each power wire 41 to the blade 11 or the sensor holder 9.

In the aforementioned embodiments, each plug 11 includes, as the first and second male connectors, two blades 11 which have thickness directions parallel with the third direction D3 and correspond to line (hot) and neutral, such as JIS C 8303 plug, NEMA 1-15 plug, NEMA 5-15 plug or the like, but the present invention is not limited to this. For example, the plug of the present invention may include as the first and second male connectors: two blades which have thick directions parallel with the second direction D2, such as BS 1363 plug or the like; two blades forming a V-shape or an upside down V-shape, such as CPCS-CCC plug, AS/NZS 3112 plug or the like; or two round pins such as BS 546 plug, BS 4573 plug, CEE 7/4 plug, CEE 7/5 plug, CEE 7/16 plug, CEE 7/17 plug, 107-2-D1 plug, CEI 23-16/VII plug, SEV 1011 plug, IEC 60906-1 plug, TIS 166-2549 plug or the like.

In the aforementioned embodiments, each plug 11 further includes, as a ground male connector (option), a ground pin 12 which has a U-shape cross-section or is shaped into a hollow cylinder, but the present invention is not limited to this. For example, the plug of the present invention may include as ground connector: two ground (earth) contacts put in recesses of the plug such as CEE 7/4 plug or the like; a ground blade such as AS/NZS 3112 plug, BS 1363 plug or the like; a half round ground pin such as 107-2-D1 plug or the like; or a round ground pin such as CEI 23-16/VII plug, SEV 1011 plug, NEMA 5-15 plug, TIS 166-2549 plug or the like.

The invention claimed is:

1. A power cord, comprising:

a plug comprising an enclosure and blades configured to be inserted into blade insertion holes of an electrical outlet, respectively, and thermal sensors provided for the blades at least one each, each of the thermal sensors being configured to detect a temperature of a corresponding blade;

a load connection portion configured to be connected to a load;

a cut-off configured to stop electric power from being supplied to the load connection portion from the blades when a temperature detected with any of the thermal sensors is higher than a prescribed temperature; and a sensor holder that is made from insulating material and retains the thermal sensors such that the sensor holder intervenes between each of the thermal sensors and a blade corresponding thereto, wherein the sensor holder is insert molded in the enclosure, and a wall of the sensor holder includes two sensor storing recesses.

2. The power cord of claim 1, wherein the thermal sensors are in contact with the blades one each.

3. The power cord of claim 1, wherein each distance between each of the thermal sensors and a blade corresponding thereto is smaller than a distance between the blades.

4. The power cord of claim 2, wherein each distance between each of the thermal sensors and a blade corresponding thereto is smaller than a distance between the blades.

5. The power cord of claim 1, wherein any one of the thermal sensors is not arranged between the blades.

6. The power cord of claim 2, wherein any one of the thermal sensors is not arranged between the blades.

7. The power cord of claim 3, wherein any one of the thermal sensors is not arranged between the blades.

8. The power cord of claim 4, wherein any one of the thermal sensors is not arranged between the blades.

* * * * *